United States Patent [19]

Faeth

[11] Patent Number: 4,827,987

[45] Date of Patent: May 9, 1989

[54] LIQUID FUEL BLOCKAGE REMOVAL DEVICE WITH A VENTURI AND BYPASS PASSAGES

[75] Inventor: Warren P. Faeth, Fort Wayne, Ind.

[73] Assignee: Tokheim Corporation, Fort Wayne, Ind.

[21] Appl. No.: 2,856

[22] Filed: Jan. 13, 1987

Related U.S. Application Data

[63] Continuation-in-part of Ser. No. 803,152, Dec. 2, 1985, abandoned.

[51] Int. Cl.[4] ..... B65B 57/14; B67D 5/06

[52] U.S. Cl. ..... 141/59; 141/44; 141/46

[58] Field of Search ..... 141/37, 44–46, 141/54–60, 67, 126, 127, 285–310; 220/85 VR, 85 VS; 417/182, 187, 185, 186, 188, 189

[56] References Cited

U.S. PATENT DOCUMENTS

| | | | |
|---|---|---|---|
| 2,307,085 | 1/1943 | Trexler | 222/72 |
| 2,540,064 | 1/1951 | Weber | 137/605 |
| 2,785,546 | 3/1957 | Baueilein | 62/339 |
| 2,969,748 | 1/1961 | Staats et al. | 417/186 |
| 3,338,173 | 8/1967 | Gunzel, Jr. et al. | 417/186 X |
| 3,850,208 | 11/1974 | Hamilton | 141/59 |
| 3,863,687 | 2/1975 | Alquist | 141/45 |
| 3,905,405 | 9/1975 | Fowler et al. | 141/46 |
| 3,913,633 | 10/1975 | Hiller | 141/45 |
| 3,915,206 | 10/1975 | Fowler et al. | 141/59 |
| 3,952,781 | 4/1976 | Hiller et al. | 141/46 |
| 3,981,334 | 9/1976 | Deters | 141/46 |
| 3,981,335 | 9/1976 | Deters | 141/46 |
| 4,009,739 | 3/1977 | Weatherford | 141/59 |
| 4,033,706 | 7/1977 | Schaefer et al. | 417/189 X |
| 4,057,085 | 11/1977 | Shihabi | 141/59 |
| 4,057,086 | 11/1977 | Healy | 141/206 |
| 4,068,687 | 1/1978 | Long | 141/59 |
| 4,072,934 | 2/1978 | Hiller et al. | 141/59 X |
| 4,095,626 | 6/1978 | Healy | 141/206 |
| 4,167,957 | 9/1979 | Voelz et al. | 141/95 |
| 4,167,958 | 9/1979 | Voelz | 141/95 |
| 4,253,503 | 3/1981 | Gunn | 141/59 |
| 4,310,033 | 1/1982 | Deters | 141/44 |
| 4,336,830 | 6/1982 | Healy | 141/59 |
| 4,395,201 | 7/1983 | Bron | 417/186 X |
| 4,396,356 | 8/1983 | Thompson | 417/186 |
| 4,566,504 | 1/1986 | Furrow et al. | 141/59 |
| 4,595,344 | 6/1986 | Briley | 417/185 |
| 4,687,033 | 8/1987 | Furrow et al. | 141/59 |

FOREIGN PATENT DOCUMENTS

| | | | |
|---|---|---|---|
| 0155186 | 9/1985 | European Pat. Off. | 141/44 |
| 0915131 | 10/1946 | France | 417/186 |
| 2016417 | 9/1979 | United Kingdom | 141/44 |

OTHER PUBLICATIONS

Instruction Manual for "Co-Vent System", Gilbarco Inc., 1984.

*Primary Examiner*—Ernest G. Cusick
*Attorney, Agent, or Firm*—Jeffers, Hoffman & Niewyk

[57] ABSTRACT

A device for mounting in a fuel dispensing hose that has a flexible inner tube defining the fuel conduit, and a tubular outer sleeve that defines with the inner tube an annular vapor return passage. The device includes an aspirating block adapted for serial connection with the inner tube within the outer sleeve. The section comprises a cylindrical block that is connected in series with ends of the inner tube and defines a venturi or jet pump forming part of the fuel conduit. The block also includes bypass passages for fuel to bypass the venturi and to increase the fuel flow through the block. The aspirating block also has radial aspirator ports which communicate between the venturi throat or jet pump and the annular vapor return passage. Each radial aspirating port includes a check valve to permit only one-way fuel flow from the fuel conduit to the vapor passage.

11 Claims, 2 Drawing Sheets

LIQUID FUEL BLOCKAGE REMOVAL DEVICE WITH A VENTURI AND BYPASS PASSAGES

RELATED APPLICATION

This application is a continuation-in-part of application Ser. No. 803,152, filed Dec. 2, 1985 abandoned in favor of Ser. No. 113,372 now U.S. Pat. No. 4,749,009.

BACKGROUND OF THE INVENTION

This invention relates to liquid fuel dispensing equipment for automotive service stations or the like whereby liquid fuel such as gasoline is dispensed from fuel storage reservoirs to automotive vehicles or, in some instances, to small fuel containers. The invention particularly relates to vapor recovery systems for such equipment wherein the escape of hydrocarbon vapors to the atmosphere during the refueling process is prevented by drawing the vapors back to the fuel storage reservoir through a vapor return line associated with a flexible fuel hose.

More particularly, the invention relates to a device for removing liquid fuel that may block the vapor return line, which liquid fuel results from condensation or splashback, for example.

Liquid fuel dispensing equipment conventionally includes a pump connected to a fuel reservoir, a valved nozzle adapted to be inserted into the fill pipe of a vehicle fuel tank, and a flexible fuel hose connected between the pump outlet pipe and the valve nozzle. The equipment also includes, in most cases, a vapor recovery system for preventing the escape of hydrocarbon fuel vapors to the atmosphere.

Previous vapor recovery systems have included passages in the valved nozzle for collecting vapor from the vehicle fuel tank, and a vapor return line integral with the flexible fuel hose for delivering the vapor back to the fuel storage reservoir. Some systems use a vacuum pump for drawing vapor through the return line and others rely on vapor pressure in the vehicle fuel tank for delivery of vapor through the vapor return line. Often, the return line is defined by the inner wall of an outer hose or sleeve and the outer surface of a smaller diameter flexible inner hose which constitutes the liquid fuel conduit.

The vapor return line, however, frequently becomes blocked with liquid fuel due to condensation of fuel vapors and/or splashback that occurs during the refueling operation. As a result, the vapor recovery system fails and hydrocarbon vapors escape to the atmosphere. Usually, the liquid fuel collects in the lowest portion of the flexible fuel hose, such as in the loop that commonly forms between the ends of the hose.

One solution to this liquid blockage problem is a system wherein a suction tube is positioned in the vapor return passage (i.e., the passage defined by the inner wall of the flexible outer sleeve and the outer wall of the fuel tube), with one end of the passage extending to the approximate low point in the conduit where liquid fuel collects. The other end of the suction tube extends to a suction-producing device which is integral with the nozzle.

The suction-producing device may include, for example, a venturi block connected in series with the liquid fuel conduit through which the fuel passes into the valved nozzle. The block defines a venturi throat and the other end of the suction tube is connected to a radial passage extending through the wall of the block to the venturi throat so that the pressure drop in the throat produces suction in the tube. Accordingly, the collected liquid fuel is drawn through the suction tube into the venturi throat and is dispensed through the nozzle with the normal fuel flow.

One disadvantage of this prior art device, however, is that the suction tube is vulnerable to blockage by small particles within the fuel hose. Also, backflow may occur when the flow of liquid fuel through the venturi is shut off.

Another disadvantage of the prior art device is that the restriction of the venturi throat prevents the flow of a sufficient amount of fuel through the fuel hose whereby the refueling process for an automotive vehicle fuel tank is relatively slow and time consuming. However, if the throat of the venturi is made larger, insufficient suction is produced in the venturi to aspirate the liquid fuel from the vapor return line into the throat of the venturi.

The device according to copending application Ser. No. 803,152, overcomes many of the difficulties and disadvantages described above and affords other features and advantages heretofore not obtainable.

That application provides a device which is adapted to be inserted in a liquid fuel dispensing hose of the coaxial type that includes an inner tube defining a fuel conduit and a tubular outer sleeve that defines, with the outer surface of the inner tube, a generally annular passage for removing fuel vapors from the vehicle fuel tank. The device includes a venturi section adapted for insertion in series with the inner tube within the outer sleeve. The venturi section comprises a cylindrical block defining axial connecting means at each end for connection to end portions of the inner tube. The block also defines a venturi throat communicating at opposite ends with the connected ends of the inner tube.

At least three radially extending aspirator elements are disposed in the block and extend radially through the venturi section at uniformly spaced radial locations in a transverse plane that intersects the block at approximately the throat of the venturi. Each aspirator element defines a radial port communicating between the venturi throat and the annular vapor passage. A check valve is associated with each aspirator element to block backflow of fuel from the fuel conduit whenever fuel flow is stopped. Accordingly, liquid fuel that condenses or collects in the annular vapor passage adjacent the venturi section will be sucked through at least one of the aspirator elements due to the suction generated in the venturi throat.

While the arrangement disclosed in the above-identified copending patent application overcomes many of the problems associated with the prior art vapor return systems, it has some inherent drawbacks. Since all of the liquid fuel is forced through the relatively small venturi nozzle, the available flow rates are relatively small and are not significantly increased by increasing the back pressure or by employing larger, and more expensive, fuel pumps.

It is, therefore, desired to provide an apparatus including further improvements upon the device disclosed in the above-identified copending patent application.

SUMMARY OF THE INVENTION

This invention overcomes the disadvantages of the above-described fuel vapor recovery system by providing an improved fuel vapor recovery system therefor.

The invention provides a device which is located in a liquid fuel dispensing hose and which provides for an improved apparatus for aspirating the collected liquid fuel from the vapor return passage. The device includes a venturi or jet pump coaxially mounted in the inner tube of a coaxial delivery hose to draw collected liquid fuel into the inner tube from the annular space between the inner and outer tubes of the coaxial delivery hose. The venturi or jet pump is provided in a cylindrical block which includes at least one bypass passage to increase the flow of liquid fuel through the inner tube.

An advantage of the apparatus according to the instant invention is that the flow rate through the fuel dispensing hose is increased without sacrificing capacity for removing blocking liquid fuel.

Another advantage of the apparatus according to the instant invention is that the structure is simple yet effective.

The present invention, in one form thereof, comprises an aspirating section for removing liquid fuel from the annular vapor return passage of a liquid fuel dispensing hose. The aspirating section is adapted for serial flow connection with the liquid fuel conduit. The aspirating section includes a hollow cylinder having a venturi throat therein and having a connecting portion at each end for connecting the aspirating section to the end portions of the liquid fuel conducting conduit. The aspirating section includes at least one axial fuel bypass passage which forms part of the fuel conduit. The aspirating section also includes at least one radial port for communicating between the venturi throat and the vapor return passage. A valve is disposed in the radial port for blocking fuel flow from the fuel conduit to the vapor passage. Liquid fuel collected in the vapor passage adjacent to the venturi is drawn through the port because of the suction generated in the throat of the venturi.

The present invention, in one form thereof, comprises a tubular outer sleeve and a tubular inner sleeve which defines a liquid fuel conduit and forms an annular vapor conduit with the outer sleeve. A liquid aspirating device for removing liquid fuel from the vapor conduit is disposed in the tubular inner sleeve and includes a cylindrical block having a venturi therein. An annular chamber surrounds at least a portion of the throat of the venturi. At least one aspirating passage interconnects the annular chamber with the annular vapor conduit, whereby liquid fuel formed by condensed fuel vapor in the annular vapor conduit is aspirated into the throat of the venturi.

It is an object of the present invention to provide a fuel vapor return passage including an effective liquid blockage removal apparatus therefor.

It is a further object of the present invention to provide a liquid fuel blockage removal apparatus for a fuel vapor return line including a jet pump.

DESCRIPTION OF THE PREFERRED EMBODIMENT

Figure 1:
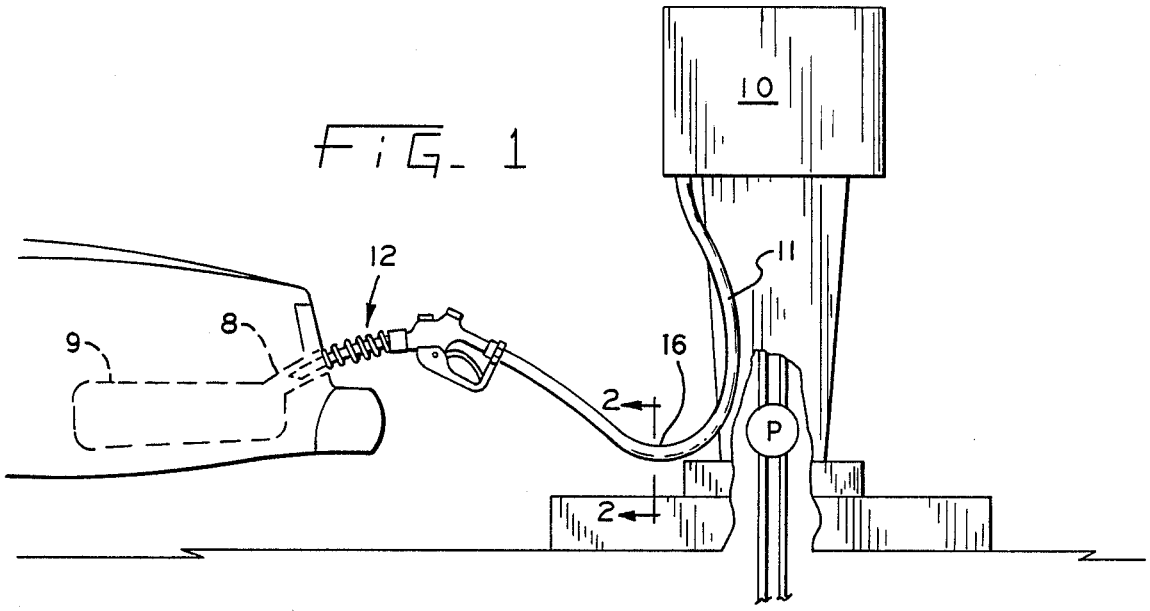
FIG. 1 is a diagrammatic view illustrating a typical fuel dispensing installation which includes a flexible fuel hose for use in an automotive vehicle service station.

Referring to the drawings, and particularly to FIG. 1, there is shown a fuel dispensing installation for an automotive vehicle service station. The installation includes a dispensing console 10 in which a pump P is located. The outlet pipe of the pump generally extends to the front or side of the console 10, where it connects to a flexible fuel hose 11, which in turn is connected to a valved nozzle 12. The valved nozzle 12 may be grasped by an operator and inserted into the fill pipe 8 of the automotive vehicle to be serviced. The flexible fuel hose 11 is generally formed of reinforced rubber and, in a typical installation, may be about 8 to 14 feet long.

The fuel hose 11 is adapted to be moved from a storage position to an extended position along with the valved nozzle 12 so that the hose and nozzle can be extended to a variety of positions for insertion of the nozzle into the fill pipe 8 of an automotive vehicle located within the range of extension of hose 11 and nozzle 12.

Figure 2:
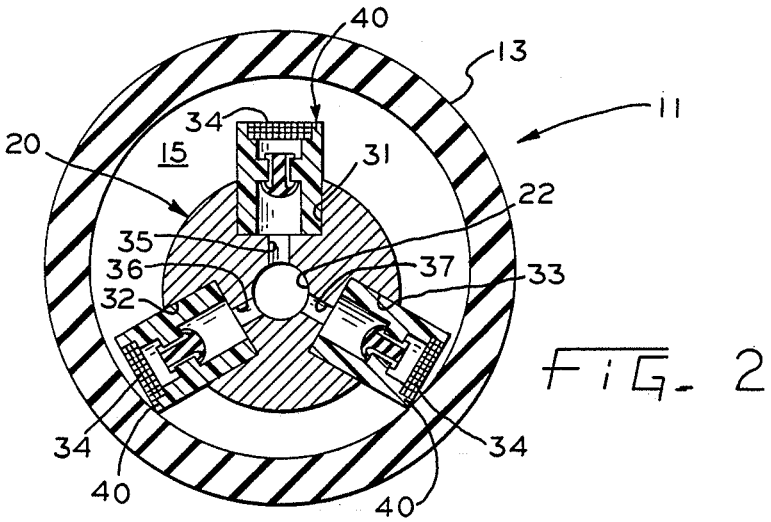
FIG. 2 is an enlarged transverse cross sectional view taken along line 2—2 of FIG. 1.
Figure 3:
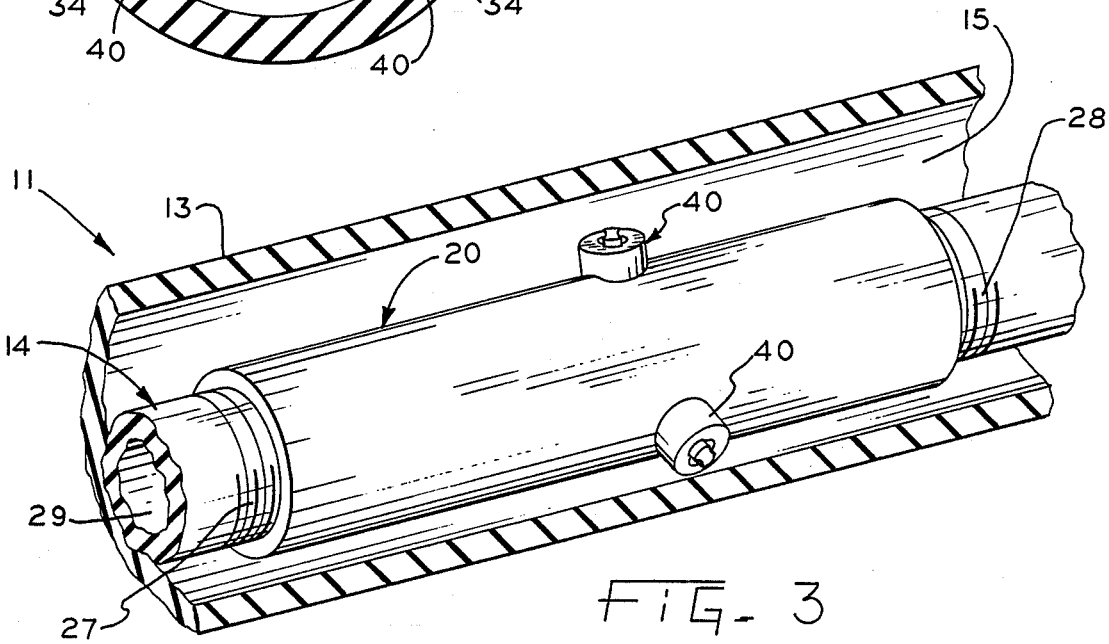
FIG. 3 is an enlarged, perspective view of the fuel hose of FIG. 1, with parts thereof broken away.

Referring to FIGS. 2 and 3, flexible fuel hose 11 includes a flexible inner fuel tube 14 through which the liquid fuel is transmitted, and an outer annular sleeve 13. The inner surface of outer sleeve 13 and the outer surface of fuel tube 14 define an annular vapor return passage 15 through which fuel vapor is returned from vehicle fuel tank 9 to the fuel reservoir (not shown).

As illustrated in FIG. 1, flexible fuel hose 11 usually has a looped portion in which the lowest portion 16 of the hose occurs. Accordingly, any condensed fuel which forms in the annular vapor return passage 15, or any fuel which enters passage 15 due to splashback from the liquid fuel being dispensed into fuel tank 9, collects or pools in the low hose zone 16. It will be apparent that, if enough liquid fuel accumulates, blockage of the vapor return passage 15 will occur and that vapor will be unable to return to the fuel storage reservoir (not shown). As a result, hydrocarbon fuel vapors will escape to the atmosphere and the purpose of the vapor recovery system will be defeated.

Figure 4:
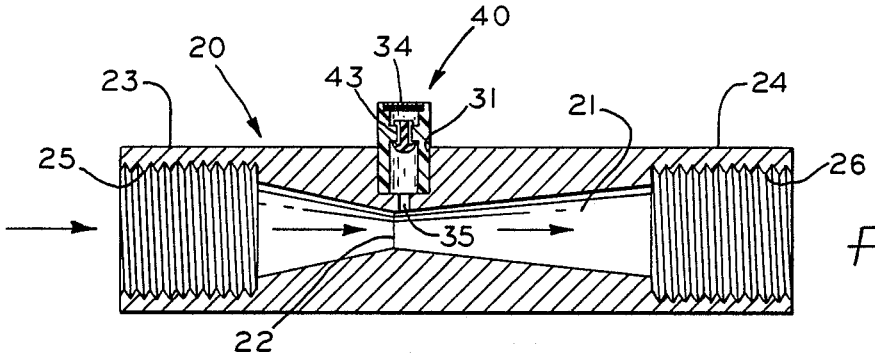
FIG. 4 is a longitudinal, sectional view through the aspirating section of the device of FIGS. 2 and 3.

In accordance with the invention, the liquid fuel which accumulates at low portion 16 of flexible fuel hose 11 is removed by means of a cylindrical aspirator block 20 which is positioned within outer sleeve 13 at the approximate low point 16 of the hose. Block 20 is connected in series with inner fuel tube 14. As best illustrated in FIGS. 2 and 4, aspirator block 20 has a generally cylindrical shape and defines a venturi 21 with a throat portion 22. Ends 23 and 24 of block 20 are respectively provided with threaded sockets 25 and 26, which are respectively adapted to receive threaded end portions 27, 28 of inner tube 14, so that venturi 21 forms a continuation of the passage 29 through which liquid fuel flows from the pump to the valved nozzle 12. Venturi block 20 is ideally positioned about 36 inches upstream from valved nozzle 12 since that is typically the location of the lowest portion 16 of the flexible fuel hose 11 during vehicle fueling operations. However, block 20 may be positioned differently depending on hose length.

Figure 5:
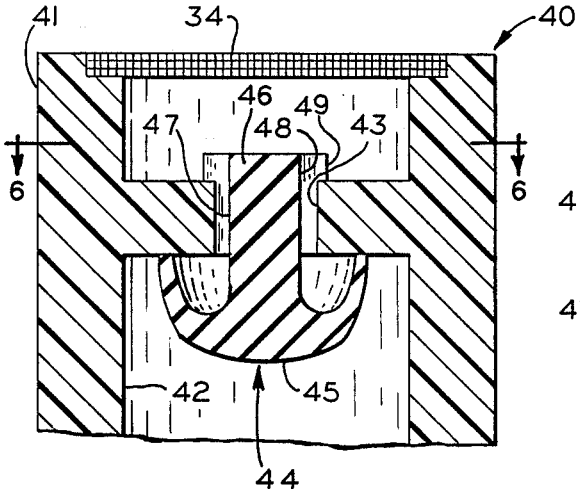
FIG. 5 is an enlarged sectional view of a portion of an aspirator device for use in the aspirating section of FIG. 4.
Figure 6:
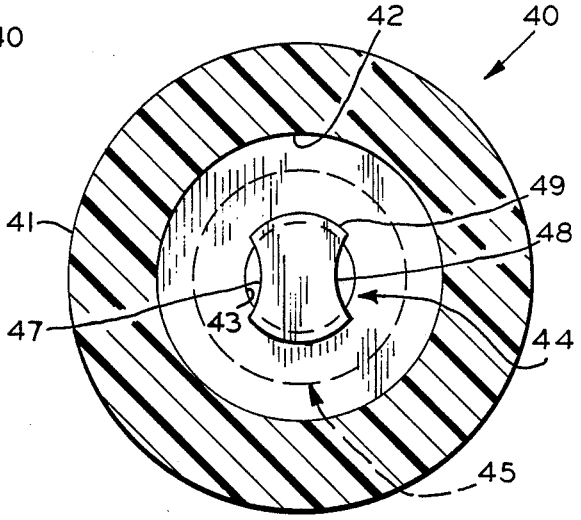
FIG. 6 is an enlarged view of the aspirator device of FIG. 5 taken along line 6—6 thereof.

Cylindrical venturi block 20 is provided with a plurality of radial bores or seats 31, 32, 33 here illustrated as three bores which are uniformly spaced around the circumference of block 20 in a plane generally intersecting throat 22 of venturi 21. Each of these bores or seats 31, 32, and 33 has a concentric passage or port 35, 36, 37 which extends from the base of the seat to venturi throat 22. Each of the seats 31, 32, and 33 has a check valve 40 seated therein of the type generally shown in FIGS. 5 and 6, and a filter 34. Filters 34 may be formed of sintered metal such as bronze and prevent impurities from contaminating valves 40. Valves 40 may be of the type generally referred to as "umbrella valves" and include a main body 41 with an open-ended valve chamber 42 formed therein and a central bore 43 extending therethrough. Mounted in central bore 43 is an elastomeric element 44 with an enlarged head portion 45 located in chamber 42 and a stem 46 which extends through central bore 43. Stem 46 has relieved side wall portions 47 and 48 that define, with bore 43, passages which extend between the outer surface of the valve body and the valve chamber 42. The valve stem 46 is locked in place by means of an enlarged flanged portion 49.

The purpose of valves 40 is to permit one way flow of liquid through the valves from the vapor return passage 15 to the venturi throat 22, and to block reverse flow through the valves.

During a refueling operation when the valved nozzle 12 is inserted into the fill pipe 8 of a vehicle fuel tank 9, the operator operates nozzle 12 so that flow of liquid fuel through hose 11 and valved nozzle 12 is commenced. As the liquid fuel flows through venturi 21, an increase in velocity occurs in the throat 22 of the venturi, accompanied by a reduction in pressure therein. The pressure drop thus produced serves to open umbrella valves 40 and to draw into venturi throat 22 any liquid fuel that has accumulated in the low portion 16 of vapor return passage 15.

Because three umbrella valves 40 are provided which are uniformly spaced about the circumference of the venturi block 20, at least one of the valves will be immersed at all times in any accumulated liquid fuel. Accordingly, the flow is effective to remove the accumulated liquid fuel so that vapor return passage 15 is maintained in an open condition and blockage is avoided.

Aspirator block 20 may be formed of anodized aluminum or brass so as to be unaffected by contaminants which could otherwise corrode the material of block 20. The umbrella valves 40 are generally formed of a resilient, plastic material that may be inserted into the bores or seats 43 formed in aspirator block 20. While the device shown has three aspirating bores 31, 32, 33, it will be apparent that more or fewer valves may be used if desired.

Figure 7:
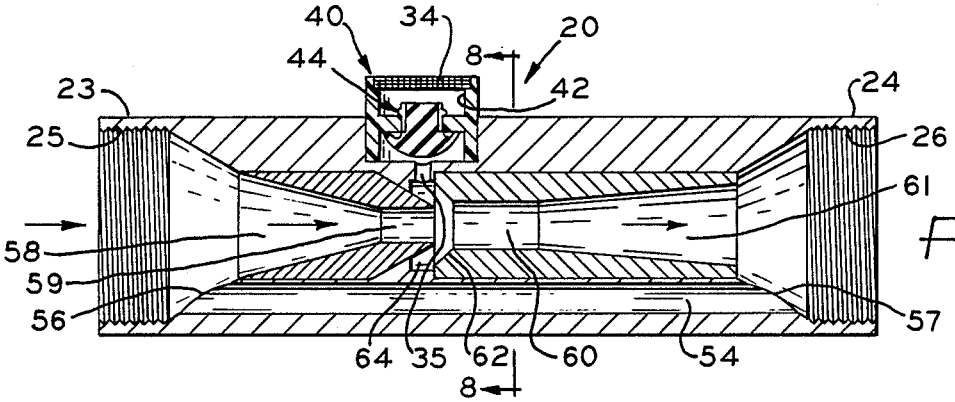
FIG. 7 is a longitudinal sectional view of another embodiment of an aspirating section for use in the apparatus of FIGS. 1, 2 and 3.
Figure 8:
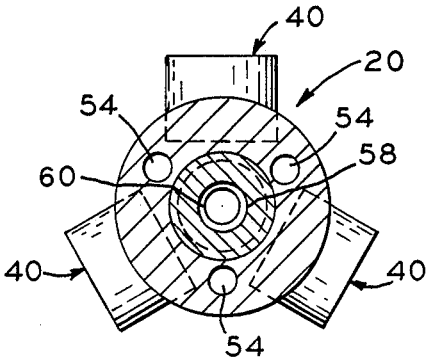
FIG. 8 is a transverse sectional view of the aspirating section of FIG. 7 taken along line 8—8 of thereof.

Referring now to FIGS. 7 and 8, there is shown an alternate embodiment of the invention. Aspirator block 20 is provided with three bypass passages 54 spaced uniformly about the circumference of aspirator block 20. Passages 54 communicate with flared end portions 56 and 57 of aspirator block 20 whereby flow of liquid fuel will occur through the three passages 54. Liquid fuel will also flow from flared end 56, a flared portion 58, a straight restricted portion 59, another straight restricted portion 60, and flared portion 61 to flared outlet portion 57. Thus, a throat section is formed by means of restricted straight portions 59 and 60 wherein the velocity of the liquid fuel will be increased and wherein, by Bernouille's Principle, the pressure will be reduced. A flared portion 62 is also provided at the junction of restricted portion 59 and restricted portion 60. Furthermore, an annular chamber 64 surrounds the throat or restricted portion 59 and communicates with flared portion 62. The annular chamber 64 also communicates by means of ports 35 and valves 40 with vapor return passage 15 as explained hereinabove. The flared and restricted portions 58–62, together with annular chamber 64, form a venturi or jet pump whereby, for a given amount of flow, a relatively large amount of suction is provided as compared to a similarly sized venturi as shown in FIG. 4. Thus, even though the amount of flow through the restricted portions 59 and 60 of the embodiment of FIG. 7 is less than the flow through the venturi of the embodiment of FIG. 4, sufficient suction will be generated for aspirating liquid fuel from vapor return passage 15 into the liquid flow path through restricted section 60. The construction of jet pumps and their operation is well known in the prior art and, therefore, need not be further explained herein. Suffice it to say that the provision of the annular chamber 64 together with the flared portion 62 whereby liquid which flows through restricted section 59 is suddenly permitted to expand in flared portion 62 generates considerable suction. The amount of flow through the aspirating block 20 including passages 62 and 60 is approximately one-fourth ($\frac{1}{4}$) of the total flow through aspirator block 20. It should be noted that while three bypass passages 54 are provided, more or fewer of these bypass passages may be provided, as desired.

It should also be understood that the venturi aspirator block 20 of FIG. 4 could be provided with bypass passages similarly to the arrangement of FIG. 7 and FIG. 8 with the attendant increase in flow through the aspirator block.

While this invention has been shown and described with respect to particular embodiments thereof, this is for the purpose of illustration rather than by way of limitation. Other variations and modifications of the specific embodiments shown and described herein will be apparent to those skilled in the art within the intended spirit and scope of the invention. Accordingly, the patent is not to be limited in scope and effect to the specific embodiments herein shown and described nor in any other way that is inconsistent with the extent to which the progress in the art has been advanced by the invention.

What is claimed is:

1. In a liquid dispensing hose for distributing liquid fuel from a pump to a nozzle adapted to be inserted into the fill pipe of a vehicle fuel tank, said hose having an inner tube defining a fuel conduit and a tubular outer sleeve which defines with the inner tube an annular vapor passage for recovering fuel vapors from the fuel tank, means for removing from said annular vapor passage liquid fuel which is formed by condensed fuel vapor comprising:

an aspirating section disposed in said outer sleeve and connected in serial flow communication with said inner tube, said aspirating section including a venturi throat therein and having connecting means at each end for connecting said aspirating section to end portions of said inner tube whereby said aspirating section and venturi throat form part of said fuel conduit;

at least one axial fuel bypass passage in said aspirating section, said passage forming part of said fuel conduit;

aspirator means defining a plurality of radial ports in said aspirating section for communicating between said venturi throat and said annular vapor passage; and a check valve means associated with each said radial port for blocking fuel flow from said fuel conduit to said annular vapor passage, said check valve means respectively having inlet openings directed radially outwardly of said aspirating section and facing toward said tubular outer sleeve, whereby liquid fuel collected in said annular passage adjacent said aspirating section is drawn through said aspirator means due to suction generated in said venturi throat.

2. The device as defined in claim 1 wherein said plurality of radial ports extend radially through said aspirating section at circumferentially uniformly spaced locations in a plane oriented transversely to the longitudinal axis of said aspirating section and which intersects said aspirating section substantially at the throat of said venturi.

3. The device as defined in claim 1 wherein said at least one bypass passage comprises three axial passages spaced radially uniformly around said aspirating section.

4. The device as defined n claim 1 wherein said aspirating section includes an annular chamber surrounding said venturi throat and in open communication therewith, said aspirator means connecting said annular chamber and said annular vapor passage.

5. The hose as defined in claim 1 wherein said check valve means comprises a plurality of umbrella check valves.

6. The device as defined in claim 1 including a plurality of filters comprised of sintered metal, each said filter respectively located upstream of a said respective check valve means in said aspirator means.

7. A liquid fuel dispensing hose and vapor return conduit comprising:

a tubular outer sleeve;

a tubular inner sleeve defining a liquid fuel conduit and forming with said outer sleeve an annular vapor conduit;

liquid aspirating means for removing liquid fuel from said vapor conduit, said liquid aspirating means being connected in serial flow communication with said tubular inner sleeve and including a cylindrical block having a venturi throat therein, an annular chamber surrounding at least a portion of said venturi throat and a plurality of aspirating inlet passages interconnecting said annular chamber and said annular vapor conduit, said aspirating inlet passages extending radially through said cylindrical block at circumferentially uniformly spaced locations in a plane which is oriented transversely to the longitudinal axis of said cylindrical block and which intersects said cylindrical block substantially at said venturi throat whereby liquid fuel formed by condensed fuel vapor in said annular vapor conduit is aspirated into said venturi throat, and a plurality of axially oriented bypass passages surrounding said venturi throat and forming part of said liquid fuel conduit.

8. The hose as set forth in claim 7 wherein said plurality of bypass passages comprises three axial passages spaced radially uniformly around said cylindrical block.

9. The hose as defined in claim 7 including a check valve disposed in each of said plurality of aspirating passages.

10. The hose as defined in claim 9 wherein said check valves comprise umbrella valves.

11. The hose as defined in claim 9 including a plurality of filters comprised of sintered metal respectively disposed in each of said plurality of aspirating passages upstream of each said check valve means.

* * * * *